US011813888B2

(12) United States Patent
Michenaud et al.

(10) Patent No.: US 11,813,888 B2
(45) Date of Patent: Nov. 14, 2023

(54) WRITING INSTRUMENT

(71) Applicant: Société BIC, Clichy (FR)

(72) Inventors: Etienne Michenaud, Clichy (FR); Franck Vadenne, Clichy (FR)

(73) Assignee: Société BIC, Clichy (FR)

( * ) Notice: Subject to any disclaimer, the term of this patent is extended or adjusted under 35 U.S.C. 154(b) by 1 day.

(21) Appl. No.: 17/471,508

(22) Filed: Sep. 10, 2021

(65) Prior Publication Data

US 2022/0088959 A1 Mar. 24, 2022

(30) Foreign Application Priority Data

Sep. 22, 2020 (EP) ..... 20315415

(51) Int. Cl.

| | |
|---|---|
| ***B43K 24/08*** | (2006.01) |
| ***B43K 7/00*** | (2006.01) |
| ***B43K 7/12*** | (2006.01) |
| ***B43K 27/00*** | (2006.01) |

(52) U.S. Cl.

CPC ..... *B43K 24/082* (2013.01); *B43K 7/005* (2013.01); *B43K 7/12* (2013.01); *B43K 27/006* (2013.01)

(58) Field of Classification Search

CPC .... B43K 24/12; B43K 24/163; B43K 27/006; B43K 27/08; B43K 27/12; B43K 24/16

See application file for complete search history.

(56) References Cited

U.S. PATENT DOCUMENTS

| | | | | |
|---|---|---|---|---|
| 7,014,380 | B2 | 3/2006 | Ono et al. | |
| 7,946,777 | B2 * | 5/2011 | Yamauchi | B43K 27/12 401/31 |
| 8,734,040 | B2 | 5/2014 | Roberts et al. | |
| 9,738,113 | B2 * | 8/2017 | Tani | B43K 24/163 |
| 10,569,596 | B2 * | 2/2020 | Ikai | B43K 15/02 |
| 10,618,343 | B1 * | 4/2020 | Arminak | B43K 21/16 |

FOREIGN PATENT DOCUMENTS

| | | | | |
|---|---|---|---|---|
| KR | 850000304 | Y1 * | 2/1985 | B43K 24/163 |
| WO | 2019129965 | A1 | 7/2019 | |
| WO | WO-2019129965 | A1 * | 7/2019 | |

OTHER PUBLICATIONS

Extended European Search Report dated Feb. 18, 2021 in European Patent Application No. 20315415.8 (9 pages).

* cited by examiner

*Primary Examiner* — David P Angwin
*Assistant Examiner* — Bradley S Oliver
(74) *Attorney, Agent, or Firm* — Bookoff McAndrews, PLLC

(57) ABSTRACT

A writing instrument, in particular a pen, comprises a housing comprising a front barrel and a rear barrel, the front barrel having a front opening, two or more cartridges for storing colorants or inks, each cartridge having a writing tip, at least one actuator for selectively moving one of the cartridges within the housing so that the writing tip of a selected cartridge extends through the front opening of the front barrel, and a cartridge guide member which is designed to guide the movement of the cartridges within the housing. The front barrel and the cartridge guide member are designed to be removed from the rear barrel for replacing one or more of the cartridges. In particular, the front barrel and the cartridge guide member may be removed from the rear barrel while the cartridge guide member may remain mounted to the front member at the same time.

20 Claims, 4 Drawing Sheets

WRITING INSTRUMENT

This application claims benefit from European patent application EP20315415.8, filed on Sep. 22, 2020, its content being incorporated herein by reference.

TECHNICAL FIELD

The present disclosure relates to the field of writing instruments, in particular pens for providing multiple colors.

TECHNICAL BACKGROUND

Writing instruments comprising a housing containing multiple cartridges, wherein a selected cartridge can be moved in axial direction so that the writing tip of the selected cartridge extends through the front opening of the housing are known in the art, for example from US 7,014,380 B2. Such writing instruments manufactured by Societe BIC is also commercially available under the tradename BIC 4 Color Pen.

The object of the present disclosure is to provide a writing instrument with improved features so that a user can more easily replace a cartridge of the writing instrument, in particular if the colorant or ink within this cartridge has been consumed, or if a user wants to exchange a cartridge containing an ink or colorant of a certain color by a cartridge containing an ink or colorant of a different color.

SUMMARY

The present disclosure relates to a writing instrument as defined in claim 1. The dependent claims depict embodiments of the present disclosure.

According to the present disclosure, a writing instrument, in particular a pen, comprises a housing comprising a front barrel and a rear barrel, the front barrel having a front opening and being removably connected to the rear barrel, two or more cartridges for storing colorants or inks, each cartridge having a writing tip, at least one actuator for selectively moving one of the cartridges within the housing so that the writing tip of a selected cartridge extends through the front opening of the front barrel, and a cartridge guide member which is designed to guide the movement of the cartridges within the housing. The front barrel and the cartridge guide member are designed to be removed from the rear barrel for replacing one or more of the cartridges. In particular, the front barrel and the cartridge guide member may be removed from the rear barrel while the cartridge guide member may remain mounted to the front member at the same time.

After the front barrel and the cartridge guide member have been removed from the rear barrel, a user easily gets access to the cartridges for replacing one or more consumed cartridges by one or more new/filled cartridges.

The cartridge guide member may be connected to the front barrel such that the cartridge guide member can rotate relative to the front barrel without moving in an axial direction relative to the front barrel. In particular, the front barrel may have a circumferential groove along its inner surface, and the cartridge guide member may have a circumferential protrusion engaging the circumferential groove of the front barrel such that the cartridge guide member can easily rotate relative to the front barrel without moving in an axial direction relative to the front barrel (or vice versa).

The front barrel may be directly connected to the rear barrel, for example via a thread engagement. In particular, the front barrel may have a male thread, and the rear barrel may have a female thread so that the front barrel can be directly connected to the rear barrel by screwing the male thread of the front barrel into the female thread of the rear barrel.

Therefore, front barrel and the cartridge guide member can together be removed from the rear barrel by unscrewing the front barrel from the rear barrel although the cartridges and the guide member cannot rotate relative to the rear barrel.

According to an aspect of the present disclosure, the writing instrument may comprise at least one pusher which is contained in the rear barrel and which can be moved in axial direction by the at least one actuator wherein the pusher transmits the movement of the at least one actuator on a cartridge for moving the cartridge through the front opening of the front barrel.

As mentioned, the cartridge guide member may be removably connected to the rear barrel such that the cartridge guide member cannot rotate relative to the rear barrel. On the other hand, the cartridge guide member can move in an axial direction relative to the rear barrel when the front barrel and the cartridge guide member are removed from the rear barrel. In particular, the rear barrel may have at least one axially extending protrusion or rib on its inner surface, and the cartridge guide member may have at least one axially extending groove for engaging the at least one axially extending protrusion or rib of the rear barrel such that the cartridge guide member cannot rotate relative to the rear barrel, but move in axial direction relative to the rear barrel when the front barrel and the cartridge guide member are removed from the rear barrel. With that, it is achieved that the cartridges remain aligned with the pushers when the front barrel and the cartridge guide member are removed from the rear barrel, or when the front barrel and the cartridge are reassembled to the rear barrel so that twisting of the cartridges within the housing is avoided.

The cartridge guide member has at least two axially extending openings and/or at least two axially extending grooves, wherein each opening and/or groove is designed to receive a portion of one of the cartridges for guiding the movement of this cartridge within the housing.

An embodiment of the present disclosure has in total four cartridges for storing colorants or inks, four actuators and four pusher for selectively moving one of the four cartridges within the housing so that the writing tip of a selected cartridge extends through the front opening of the front barrel. In this case, the cartridge guide member also has four axially extending openings and/or grooves, each guiding the moving of a specific cartridge within the housing. But of course, also more or less cartridges (as well as more or less openings/grooves in the cartridge guide member) may be used, for example three cartridges or five cartridges.

At least one pusher is contained in the rear barrel which can be moved in axial direction by the at least one actuator wherein the pusher transmits the movement of the at least one actuator on a cartridge for moving the cartridge through the front opening of the front barrel. The pusher and the actuator may form a single integral unit. In addition, a compression spring may be arranged between each cartridge and its assigned pusher.

A single actuator may be used which can be rotatably connected to the rear end of the rear barrel. By rotating the actuator, the actuator can be aligned with a specific cartridge in order to move the cartridge in axial direction by moving the actuator (for example by a thumb of a user). However, in some circumstances according to the present disclosure, the number of actuators corresponds to the number of cartridges, wherein each actuator is always aligned to an assigned cartridge. In this case, the actuators are designed such that only one of the actuators can be axially moved to move one of the cartridges within the housing so that the writing tip of a selected cartridge extends through the front opening of the front barrel. This can for example be achieved by a first protrusion and a second protrusion on each actuator, wherein the first protrusion of an actuator can engage the second protrusions of the other actuators to hold this actuator in an axially advanced position. When a first actuator is held in an axially advanced position, and when a second actuator is moved in axial direction towards the front barrel, the second protrusion of the second actuator disengages the first protrusion of the first actuator so that the first actuator returns to its original position due to the force of the compression spring.

A pusher link member may be arranged between each pusher and its assigned compression spring, wherein one end of each compression spring engages the respective pusher link member. The pusher link member may have an opening receiving an end of the pusher wherein sufficient friction is provided between the opening and the end of the pusher so that these part remain mounted to each other when the front barrel and the cartridge guide member are demounted from the rear barrel. The compression springs may also be connected with sufficient friction to the respective pusher link member so that the compression springs remain mounted to the pusher link members when the front barrel and the cartridge guide member are demounted from the rear barrel.

Each pusher link member may have an extension with a ball tip which may protrude into a rear opening of its assigned cartridge. The ball tip also is in frictional engagement with the rear opening of the respective cartridge. This engagement allows a slight tilting movement of the cartridge with respect to the pusher link so that the ball tip acts like a hinge, in particular when the cartridge is moved in axial direction so that its tip extends through the opening of the front barrel. Instead of a ball tip, also a flexible extension can be used wherein the flexible extension engages the opening of the cartridge, and wherein the flexible extension acts like a hinge due to its flexibility.

The total frictional force between a cartridge and the ball tip (or the flexible extension) may be lower than the total frictional force between the compression spring and pusher link member and lower than the total frictional force between the pusher link member and the pusher (for example less than 90 or 80% of each of the latter two frictional forces). When the front barrel and the cartridge guide member are demounted from the rear barrel, the cartridges remain on the side of the rear barrel and are pulled out of the front barrel and of the cartridge guide member. When a user then applies a pulling force on a cartridge, only the cartridge will be released from the ball tip of the pusher link member without demounting the pusher link member from the pusher. Said in other words, a user can easily remove a cartridge while the compression springs, the pusher link members and the pushers remain mounted to the rear barrel.

In the mounted state of the writing instrument, the other ends of the compression springs are held within openings of the cartridge guide member so that the cartridge guide member acts as a support for the compression springs.

According to another aspect of the present disclosure, a pusher holder may be arranged within the rear barrel for holding and/or guiding the at least one pusher. The pusher holder may have axially extending holes, namely one hole for each pusher for holding and/or guiding the axial movement of the pusher withing the rear barrel. The pusher holder is non-rotatably mounted within the rear barrel. This can for example be achieved by axially extending grooves in the pusher holder which engage axially extending protrusions on the inner surface of the rear barrel. The pusher holder may have a circumferential groove which engages a circumferential protrusion on the inner surface of the rear barrel for mounting the pusher holder in an axially fixed position. In addition, a rear surface of the pusher holder may abut a shoulder of the rear barrel for mounting the pusher holder in an axially fixed position.

When a user removes the front barrel and the cartridge guide member from the rear barrel, the pusher holder ensures that the at least one pusher remain mounted within the rear barrel. With that, a user can more easily to reassemble the writing instrument after a cartridge has been exchanged by another cartridge.

A writing instrument of the present disclosure has in total four cartridges for storing colorants or inks, four actuators and four pusher for selectively moving one of the four cartridges within the housing so that the writing tip of a selected cartridge extends through the front opening of the front barrel. However, the present disclosure also covers writing instruments having more or less cartridges (for example two, three, five or six cartridges).

The writing tips of the cartridge may be ballpoint tips which are arranged at the front end of the cartridges. However, the present disclosure covers all types of writing tips, for example felt tips.

Each cartridge may contain a colorant or ink of a different color compared to the colorant or inks contained in the other cartridges. In case of four cartridges, the colors are usually black, blue, red and green. Alternatively or additionally, one of the cartridges may include a mechanical pencil mechanism.

BRIEF DESCRIPTION OF THE DRAWINGS

Additional details and features of the disclosure are described with reference to the following figures in which.

DETAILED DESCRIPTION

Embodiments of the writing instrument according to the disclosure will be described with reference to the figures as follows.

Figure 1:
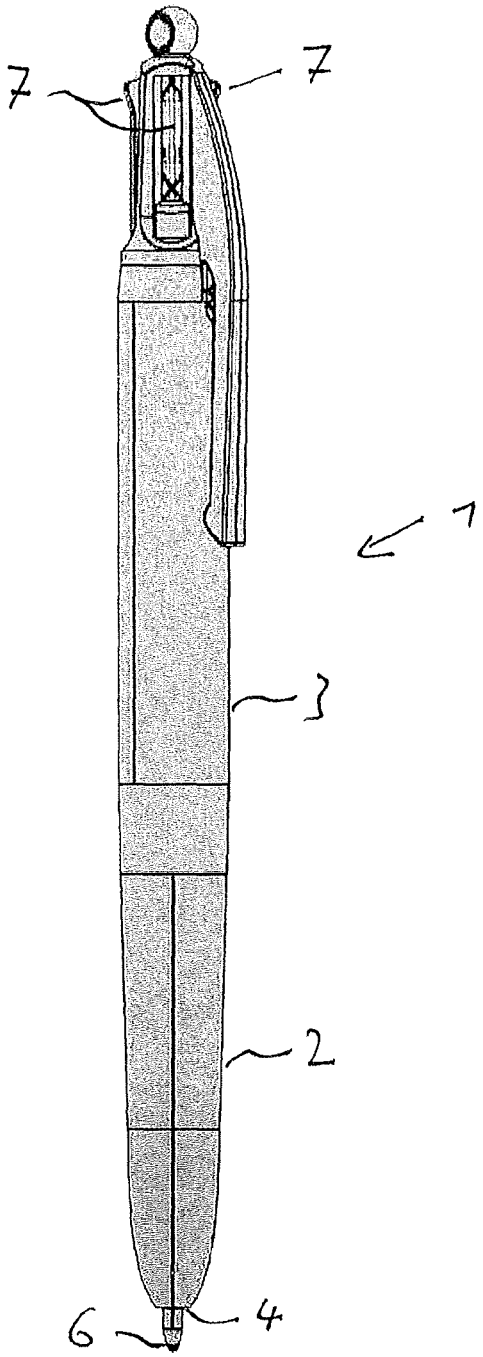
FIG. 1 shows a writing instrument according to one embodiment of the present disclosure in a mounted state.

FIG. 1 shows a writing instrument 1, in particular a pen, according to one embodiment of the present disclosure in a mounted state. The writing instrument comprises a housing having a front barrel 2 and a rear barrel 3, the front barrel having a front opening 4. The writing instrument comprises four cartridges for storing colorants or inks, each cartridge having a writing tip 6. The writing tips of the cartridge may be ballpoint tips which are arranged at the front end of the cartridges. However, the present disclosure covers all types of writing tips, for example felt tips. It should also be understood that the present disclosure may have more or less cartridges, for example two, three, five or six cartridges. Each cartridge may contain a colorant or ink of a different color compared to the colorant or inks contained in the other cartridges. In case of four cartridges, the colors are usually black, blue, red and green.

The writing instrument shown in FIG. 1 has four actuators 7 for selectively moving one of the cartridges 5 within the housing so that the writing tip 6 of a selected cartridge extends through the front opening 4 of the front barrel. However, it should be understood that also a single actuator 7 may be used for selectively moving the cartridges. For example, a single actuator 7 may be rotatably mounted at the end of the rear barrel 3 to bring the actuator 7 in line with a specific cartridge for moving the writing tip of this cartridge through the front opening 4.

Figure 2:
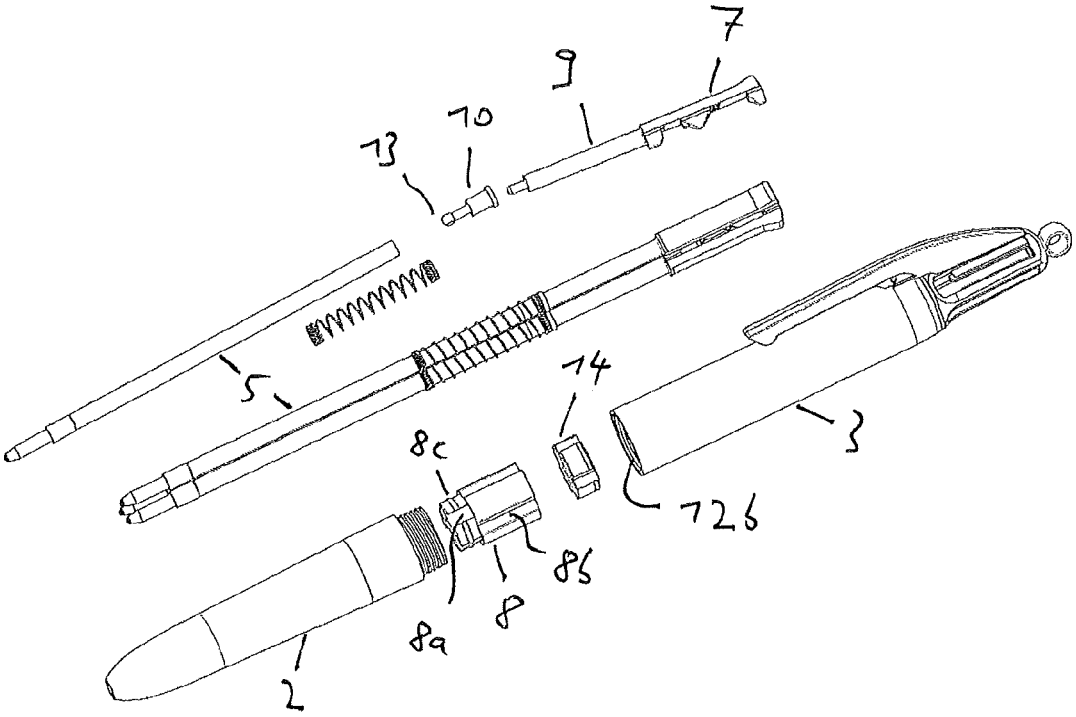
FIG. 2 shows a writing instrument according to one embodiment of the present disclosure in a demounted state.

FIG. 2 shows a writing instrument according to one embodiment of the present disclosure in a demounted state. The writing instrument comprises a cartridge guide member 8 which is designed to guide the movement of the cartridges within the housing. In order to achieve this guided movement of the cartridge, the cartridge guide member 8 has longitudinally extending (i.e. parallel to the longitudinal axis of the writing instrument) grooves 8*a* on its front part and through holes on its rear part. The number of grooves and through holes corresponds to the number of cartridges.

The writing instrument shown in FIG. 2 comprises four pushers 9 which are contained in the rear barrel 3 and which can be moved in axial direction by an actuator 7 wherein the pusher 9 transmits the movement of the respective actuator 7 on a cartridge 5 for moving the cartridge through the front opening of the front barrel. In the shown embodiment, the pusher 9 and its assigned actuator 7 are made of a single piece.

According to the present disclosure, the front barrel 2 and the cartridge guide member 8 are designed to be removed from the rear barrel 3 for replacing one or more of the cartridges 5. In particular, the front barrel 2 and the cartridge guide member 8 may be removed from the rear barrel 3 while the cartridge guide member remains mounted to the front member at the same time.

Figure 3A:
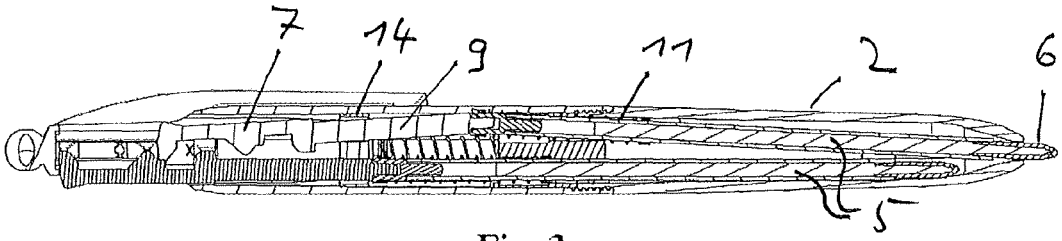
FIG. 3*a* shows a longitudinal cross-section of a writing instrument according to one embodiment of the present disclosure.
Figure 6:
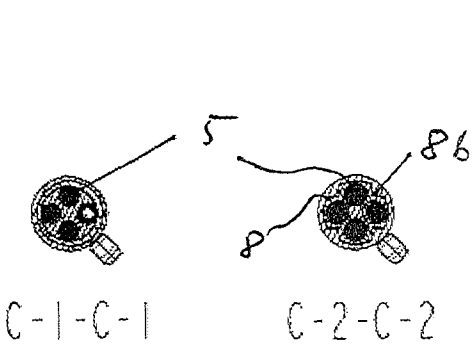
FIG. 6 shows cross-sections of a writing instrument according to an embodiment of the present disclosure in a mounted state.
Figure 6:
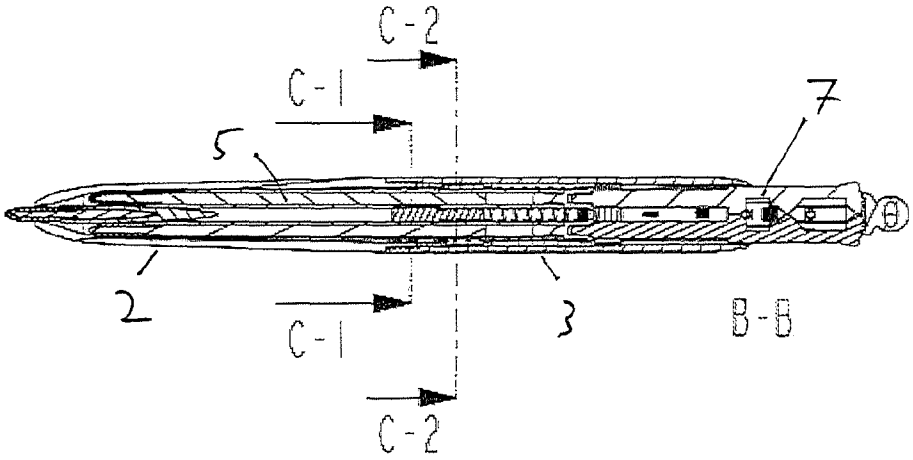

In the embodiment shown in FIGS. 2, 3*a* and 6, the front barrel 2 is directly connected to the rear barrel 3 via a thread engagement. In particular, the front barrel 2 has a male thread 12*a*, and the rear barrel 3 has a female thread 12*b* so that the front barrel can be directly connected to the rear barrel by screwing the male thread of the front barrel into the female thread of the rear barrel. The cartridge guide member 8 is connected to the front barrel 2 such that the cartridge guide member 8 can rotate relative to the front barrel 2 without moving in an axial direction relative to the front barrel 2.

In particular, the front barrel 2 may have a circumferential groove along its inner surface, and the cartridge guide member 8 may have a circumferential protrusion 8*c* engaging the circumferential groove of the front barrel such that the cartridge guide member 8 can easily rotate relative to the front barrel without moving in an axial direction relative to the front barrel. In addition, the cartridge guide member 8 may have longitudinally extending grooves 8*b* which are designed for engaging (for example longitudinally extending) protrusions of the rear barrel 3 for ensuring that the cartridge guide member 8 and the cartridges to not rotate when the front barrel 2 is screwed off from the rear barrel 3.

Therefore, front barrel 2 and the cartridge guide member 8 can together be removed from the rear barrel 3 by unscrewing the front barrel 2 from the rear barrel 3 although the cartridges 5 and the cartridge guide member 8 cannot rotate relative to the rear barrel 3. After the front barrel 2 and the cartridge guide member 8 have been removed from the rear barrel 3, a user easily gets access to the cartridges for replacing one or more consumed cartridges 5 by one or more new/filled cartridges.

As mentioned, the cartridge guide member 8 may be connected to the rear barrel 3 such that the cartridge guide member 8 cannot rotate relative to the rear barrel. On the other hand, the cartridge guide member 8 can move in an axial direction relative to the rear barrel 3 when the front barrel 2 and the cartridge guide member 8 are removed from the rear barrel 3. In particular, the rear barrel 3 may have at least one axially extending protrusion or rib on its inner surface (not shown in FIG. 2), and the cartridge guide member 8 may have at least one axially extending groove 8*b* for engaging the at least one axially extending protrusion or rib of the rear barrel 3 such that the cartridge guide member 8 cannot rotate relative to the rear barrel, but move in axial direction relative to the rear barrel 3 when the front barrel 2 and the cartridge guide member 8 are removed from the rear barrel 3. With that, it is achieved that the cartridges 5 remain aligned with the pushers when the front barrel and the cartridge guide member are removed from the rear barrel, or when the front barrel and the cartridge are reassembled to the rear barrel so that twisting of the cartridges within the housing is avoided.

The pushers 9 are contained in the rear barrel 3 and can be moved in axial direction by the at least one actuator wherein the pusher transmits the movement of the at least one actuator on a cartridge 5 for moving the cartridge through the front opening 4 of the front barrel 2. As said, a pusher 9 and an assigned actuator 7 may form a single integral unit. In addition, a compression spring 11 may be arranged between each cartridge and its assigned pusher.

As already mentioned, a single actuator 7 may be used which can be rotatably connected to the rear end of the rear barrel 3. By rotating the actuator, the actuator can be aligned with a specific cartridge in order to move the cartridge in axial direction by moving the actuator (for example by a thumb of a user). However, in circumstances according to the present disclosure, the number of actuators corresponds to the number of cartridges, wherein each actuator is always aligned to an assigned cartridge. In this case, the actuators are designed such that only one of the actuators 7 can be axially moved to move one of the cartridges 5 within the housing so that the writing tip of a selected cartridge extends through the front opening of the front barrel.

Figure 3B:
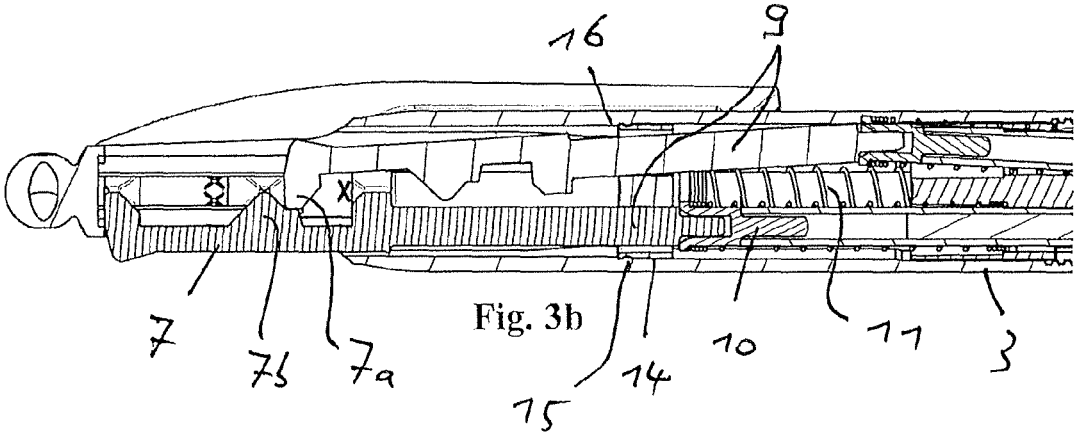
FIG. 3*b* shows an enlarged portion of the longitudinal cross-section of the writing instrument of FIG. 3*a;*
Figure 4:
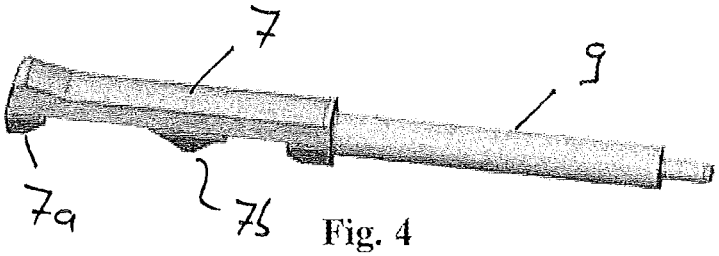
FIG. 4 shows a pusher element according to one embodiment of the present disclosure.

As shown in FIGS. 3*b* and 4, this can for example be achieved by a first protrusion 7*a* and a second protrusion 7*b* on each actuator, wherein the first protrusion 7*a* of an actuator can engage the second protrusions 7*b* of the other actuators to hold this actuator in an axially advanced position. When a first actuator is held in an axially advanced position, and when a second actuator is moved in axial direction towards the front barrel, the second protrusion of the second actuator 7*b* disengages the first protrusion 7*a* of the first actuator so that the first actuator returns to its original position due to the force of the compression spring.

As shown in FIGS. 2, 3*a* and 3*b*, a pusher link member 10 may be arranged between each pusher and its assigned compression spring 11, wherein one end of each compression spring engages the respective pusher link member 10. The pusher link member 10 may have an opening receiving an end of the pusher 9 wherein sufficient friction is provided between the opening and the end of the pusher 9 so that these part remain mounted to each other when the front barrel and the cartridge guide member are demounted from the rear barrel. The compression springs 11 may also be connected with sufficient friction to the respective pusher link member 10 so that the compression springs remain mounted to the pusher link members when the front barrel and the cartridge guide member are demounted from the rear barrel.

Each pusher link member may have an extension with a ball tip 13 (see FIG. 2, which may also be a cone shaped tip or a semi-sphere tip) which may protrude into a rear opening of its assigned cartridge. The ball tip also is in frictional engagement with the rear opening of the respective cartridge. This engagement allows a slight tilting movement of the cartridge with respect to the pusher link so that the ball tip acts like a hinge, in particular when the cartridge is moved in axial direction so that its tip extends through the opening of the front barrel. Instead of a ball tip 13, also a flexible extension can be used wherein the flexible extension engages the opening of the cartridge, and wherein the flexible extension acts like a hinge due to its flexibility.

The total frictional force between a cartridge 5 and the ball tip 13 (or the flexible extension) may be lower than the total frictional force between the compression spring 11 and pusher link member 10 and lower than the total frictional force between the pusher link member 10 and the pusher 9 (for example less than 90 or 80% of each of the latter two frictional forces). When the front barrel and the cartridge guide member are demounted from the rear barrel, the cartridges 5 remain on the side of the rear barrel 3 and are pulled out of the front barrel and of the cartridge guide member. When a user then applies a pulling force on a cartridge 5, only the cartridge will be released from the ball tip 13 of the pusher link member without demounting the pusher link member from the pusher. Said in other words, a user can easily remove a cartridge while the compression springs, the pusher link members and the pushers remain mounted to the rear barrel.

As an alternative, the pusher link member remains attached on the cartridge due to a relatively high friction force between the cartridge and the pusher link member. While the user unscrews the front barrel and separates it from the rear barrel the cartridges with their pusher link member (and the spring) follow it. No further force is needed to be applied in order to separate the pusher link members from the pushers. Thus the process of replacement is even easier.

In the mounted state of the writing instrument, the other ends of the compression springs 11 are held within openings of the cartridge guide member so that the cartridge guide member acts as a support for the compression springs.

According to another aspect of the present disclosure, a pusher holder 14 may be arranged within the rear barrel 3 for holding and/or guiding the at least one pusher 9 (see FIGS. 2, 3*a* and 3*b*). The pusher holder 14 may have axially extending holes, namely one hole for each pusher for holding and/or guiding the axial movement of the pusher withing the rear barrel. The pusher holder 14 is non-rotatably mounted within the rear barrel. This can for example be achieved by axially extending grooves 15 in the pusher holder which engage axially extending protrusions on the inner surface of the rear barrel. The pusher holder may have a circumferential groove which engages a circumferential protrusion on the inner surface of the rear barrel for mounting the pusher holder in an axially fixed position. In addition, a rear surface of the pusher holder may abut a shoulder 16 of the rear barrel for mounting the pusher holder in an axially fixed position (see FIG. 3*b*).

When a user removes the front barrel and the cartridge guide member from the rear barrel, the pusher holder 14 ensures that the at least one pusher remain mounted within the rear barrel. With that, a user can more easily to reassemble the writing instrument after a cartridge has been exchanged by another cartridge.

Figure 5:
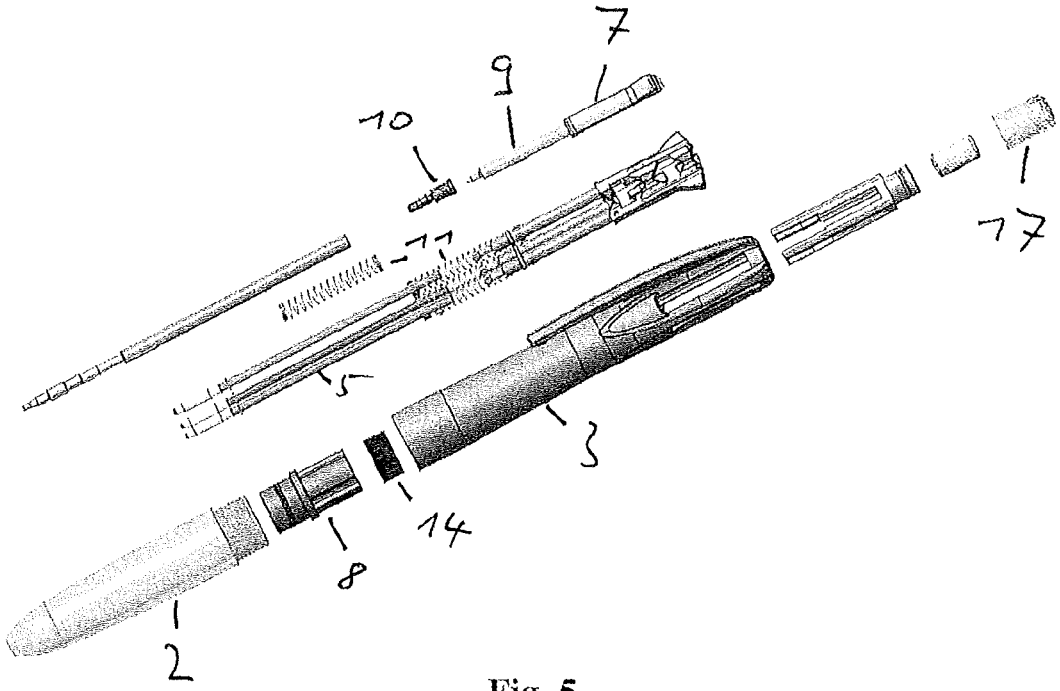
FIG. 5 shows a writing instrument according to another embodiment of the present disclosure in a demounted state.

FIG. 5 shows a writing instrument according to another embodiment of the present disclosure in a demounted state. In addition to the embodiment discussed in context with FIGS. 1 to 3*b*, this embodiment has a transparent front barrel 2, and the cartridges are colored corresponding to the colorant/ink which is contained in that cartridge. Therefore, a user can ensure that the correct cartridge has been selected and advanced through the front opening. 4. Alternatively, the tubular part of the cartridge may also be transparent so that a user can directly see the ink/colorant within the cartridge. In addition, a writing instrument according to the present disclosure may also have an eraser 17 mounted at the rear end of the rear barrel 3.

Although the present disclosure has been described above and is defined in the attached embodiments, the disclosure may alternatively be defined in accordance with the following embodiments:

1. A writing instrument, in particular a pen, comprising
   a housing comprising a front barrel and a rear barrel, the front barrel having a front opening,
   ore or more cartridges for storing colorants or inks, each cartridge having a writing tip,
   at least one actuator for selectively moving one of the cartridges within the housing so that the writing tip of a selected cartridge extends through the front opening of the front barrel, and
   a cartridge guide member which is designed to guide the movement of the cartridges within the housing,
   wherein the front barrel and the cartridge guide member are designed to be removed from the rear barrel for replacing one or more of the cartridges.
2. A writing instrument according to embodiment 1, wherein the cartridge guide member is connected to the front barrel such that the cartridge guide member can rotate relative to the front barrel without moving in an axial direction relative to the front barrel.
3. A writing instrument according to embodiment 1 or 2, wherein the cartridge guide member is connected to the rear barrel such that the cartridge guide member cannot rotate relative to the rear barrel.
4. A writing instrument according to one of the preceding embodiments, wherein the cartridge guide member is connected to the rear barrel such that the cartridge guide member can move in an axial direction relative to the rear barrel when the front barrel and the cartridge guide member are removed from the rear barrel.
5. A writing instrument according to one of the preceding embodiments, wherein the front barrel has a circumferential groove along its inner surface, and wherein the cartridge guide member has a circumferential protrusion engaging the circumferential groove of the front barrel such that the cartridge guide member can rotate relative to the front barrel without moving in an axial direction relative to the front barrel.

6. A writing instrument according to one of the preceding embodiments, wherein the rear barrel has at least one axially extending protrusion or rib on its inner surface, and wherein the cartridge guide member has at least one axially extending groove for engaging the at least one axially extending protrusion or rib of the rear barrel such that the cartridge guide member cannot rotate relative to the rear barrel, but move in axial direction relative to the rear barrel when the front barrel and the cartridge guide member are removed from the rear barrel.
7. A writing instrument according to one of the preceding embodiments, wherein the cartridge guide member has at least two axially extending openings and/or at least two axially extending grooves, wherein each opening and/or groove is designed to receive a portion of one of the cartridges for guiding the movement of this cartridge within the housing.
8. A writing instrument according to one of the preceding embodiments, wherein the front barrel is directly connected to the rear barrel.
9. A writing instrument according to one of the preceding embodiments, wherein the front barrel is directly connected to the rear barrel via a thread engagement.
10. A writing instrument according to one of the preceding embodiments, wherein the front barrel has a male thread, and wherein the rear barrel has a female thread so that the front barrel can be directly connected to the rear barrel by screwing the male thread of the front barrel into the female thread of the rear barrel.
11. A writing instrument according to one of the preceding embodiments, wherein at least one pusher is contained in the rear barrel which can be moved in axial direction by the at least one actuator wherein the pusher transmits the movement of the at least one actuator on a cartridge for moving the cartridge through the front opening of the front barrel.
12. A writing instrument according to one of the preceding embodiments, wherein the pusher and the actuator form a single integral unit.
13. A writing instrument according to one of the preceding embodiments, wherein a compression spring is arranged between each cartridge and its assigned pusher.
14. A writing instrument according to one of the preceding embodiments, wherein the compression springs are held within openings of the cartridge guide member.
15. A writing instrument according to one of the preceding embodiments, wherein a pusher link member is arranged between each pusher and its assigned compression spring, wherein one end of each compression spring engages the respective pusher link member.
16. A writing instrument according to one of the preceding embodiments, wherein a pusher holder is arranged within the rear barrel for holding and/or guiding the at least one pusher.
17. A writing instrument according to one of the preceding embodiments, wherein the pusher holder is non-rotatably mounted within the rear barrel.
18. A writing instrument according to one of the preceding embodiments, wherein the pusher holder has a circumferential groove which engages a circumferential protrusion on the inner surface of the rear barrel for mounting the pusher holder in an axially fixed position.
19. A writing instrument according to one of the preceding embodiments, wherein a rear surface of the pusher holder abuts a shoulder of the rear barrel for mounting the pusher holder in an axially fixed position.
20. A writing instrument according to one of the preceding embodiments, comprising in total four cartridges for storing colorants or inks, four actuators and four pusher for selectively moving one of the four cartridges within the housing so that the writing tip of a selected cartridge extends through the front opening of the front barrel.
21. A writing instrument according to one of the preceding embodiments, wherein the actuators are designed such that only one of the actuators can be axially moved to move one of the cartridges within the housing so that the writing tip of a selected cartridge extends through the front opening of the front barrel.
22. A writing instrument according to one of the preceding embodiments, wherein each actuator has a first protrusion and a second protrusion, wherein the first protrusion of an actuator can engage the second protrusions of the other actuators to hold this actuator in an axially advanced position.
23. A writing instrument according to one of the preceding embodiments, wherein when a first actuator is held in an axially advanced position, and when a second actuator is moved in axial direction towards the front barrel, the second protrusion of the second actuator disengages the first protrusion of the first actuator so that the first actuator returns to its original position due to the force of the compression spring.
24. A writing instrument according to one of the preceding embodiments, wherein the writing tips of the cartridge are ballpoints or felt tips.
25. A writing instrument according to one of the preceding embodiments, wherein each cartridge contains a colorant or ink of a different color compared to the colorant or inks contained in the other cartridges.
26. A writing instrument according to one of the preceding embodiments, comprising four cartridges containing colorants or inks of the colors black, blue, red and green.

The invention claimed is:

1. A writing instrument, comprising a housing comprising a front barrel and a rear barrel, the front barrel having a front opening and being removably connected to the rear barrel, at least two cartridges for storing colorants or inks, each cartridge having a writing tip, wherein the at least two cartridges includes a first cartridge, a first actuator with a first pusher for selectively moving the first cartridge within the housing so that the writing tip of the first cartridge extends through the front opening of the front barrel, a first link member having a round tip configured to protrude into an opening of the first cartridge, wherein the first cartridge is configured to move about the round tip of the first link member;

a pusher holder configured to receive at least the first pusher operatively connected with the first actuator and the rear barrel;

a cartridge guide member configured to guide the movement of the at least two cartridges within the housing, and wherein the front barrel and the cartridge guide member are configured to be removed from the rear barrel and from the pusher holder for replacing one or more of the at least two cartridges, leaving the first actuator and the first pusher within the rear barrel.

2. A writing instrument according to claim 1, wherein the cartridge guide member is removably connected to the front barrel such that the cartridge guide member is configured to rotate relative to the front barrel without moving in an axial direction relative to the front barrel.

3. A writing instrument according to claim 1, wherein the cartridge guide member is connected to the rear barrel such that the cartridge guide member is prevented from rotating relative to the rear barrel.

4. A writing instrument according to claim 1, wherein the cartridge guide member is connected to the rear barrel such that the cartridge guide member is configured to move in an axial direction relative to the rear barrel when the front barrel and the cartridge guide member are removed from the rear barrel.

5. A writing instrument according to claim 1, wherein the front barrel has a circumferential groove along its inner surface, and wherein the cartridge guide member has a circumferential protrusion engaging the circumferential groove of the front barrel such that the cartridge guide member is configured to rotate relative to the front barrel without moving in an axial direction relative to the front barrel.

6. A writing instrument according to claim 1, wherein the rear barrel has at least one axially extending protrusion or rib on its inner surface, and wherein the cartridge guide member has at least one axially extending groove for engaging the at least one axially extending protrusion or rib of the rear barrel such that the cartridge guide member is prevented from rotating relative to the rear barrel, but is configured to move in axial direction relative to the rear barrel when the front barrel and the cartridge guide member are removed from the rear barrel.

7. A writing instrument according to claim 1, wherein the cartridge guide member has at least two axially extending openings and/or at least two axially extending grooves, wherein each opening and/or groove is designed to receive a portion of one of the cartridges for guiding the movement of this cartridge within the housing.

8. A writing instrument according to claim 1, wherein the front barrel has a male thread, and wherein the rear barrel has a female thread such that the front barrel is directly connected to the rear barrel by screwing the male thread of the front barrel into the female thread of the rear barrel.

9. A writing instrument according to claim 1, further comprising a first pusher contained in the rear barrel and configured to be moved in an axial direction by the first actuator, wherein the first pusher is coupled to the first link member and is configured to transmit the movement of the first actuator on the first cartridge for moving the first cartridge through the front opening of the front barrel.

10. A writing instrument according to claim 9, wherein the first pusher and the first actuator form a single integral unit.

11. A writing instrument according to claim 9, wherein a first compression spring is coupled to the first pusher.

12. A writing instrument according to claim 11, wherein:

the at least two cartridges includes a second cartridge;

the writing instrument includes a second actuator;

a second pusher is contained in the rear barrel and is configured to be moved in the axial direction by the second actuator;

a second link member is configured to protrude into a rear opening of the second cartridge;

the second pusher is coupled to the second link member;

a second compression spring is coupled to the second link member; and the first and second compression springs are held within openings of the cartridge guide member.

13. A writing instrument according to claim 1, further comprising a first pusher and a second pusher contained in the rear barrel and configured to be moved in an axial direction, wherein a pusher holder is arranged within the rear barrel for holding and/or guiding the first pusher and the second pusher, wherein the pusher holder is non-rotatably mounted within the rear barrel, and wherein the pusher holder is configured such that, when the front barrel and the cartridge guide member are removed, at least one of the first pusher or the second pusher remains mounted within the rear barrel.

14. A writing instrument according to claim 13, wherein the pusher holder has a circumferential groove which engages a circumferential protrusion on the inner surface of the rear barrel for mounting the pusher holder in an axially fixed position, wherein a rear surface of the pusher holder abuts a shoulder of the rear barrel for mounting the pusher holder in an axially fixed position.

15. A writing instrument according to claim 1, wherein the at least two cartridges includes a second cartridge, a third cartridge, and a fourth cartridge for storing colorants or inks, and the writing instrument further comprises:

a second pusher and a second actuator to selectively move the second cartridge, a third pusher and a third actuator to selectively move the third cartridge, and a fourth pusher and a fourth actuator to selectively move the cartridge.

16. A writing instrument according to claim 1, wherein the at least two cartridges includes a second cartridge, wherein a second actuator is configured to selectively move the second cartridge, wherein each of the first and second actuators has a first protrusion and a second protrusion, wherein the first protrusion of the first actuator is configured to engage the second protrusion of the second actuator to hold the first actuator in an axially advanced position.

17. A writing instrument according to claim 1, wherein the first link member is coupled to a first compression spring, and a frictional force between the first cartridge and the round tip is less than a frictional force between the first link member and the first compression spring.

18. A writing instrument, comprising:

a housing comprising a front barrel and a rear barrel, the front barrel having a front opening and being removably connected to the rear barrel, at least two cartridges for storing colorants or inks, each cartridge having a writing tip, at least one actuator for selectively moving one of the cartridges within the housing so that the writing tip of a selected cartridge extends through the front opening of the front barrel, at least one pusher contained in the rear barrel and configured to be moved in an axial direction by the at least on actuator, wherein the at least one pusher transmits the movement of the at least one actuator on a cartridge for moving the cartridge through the front opening of the front barrel, a cartridge guide member removably coupled with each of the front barrel and rear barrel of the housing, the cartridge guide member configured to guide the movement of the cartridges within the housing, and a pusher holder configured to hold and/or guide the at least one pusher, wherein the front barrel and the cartridge guide member are configured to be removed from the rear barrel for replacing one or more of the at least two cartridges, and wherein, when the front barrel and the cartridge guide member are removed, the pusher holder ensures that a pusher among the at least one pusher remains mounted within the rear barrel.

19. The writing instrument of claim 18, wherein the pusher holder is non-rotatably mounted within the rear barrel, and the pusher holder ensures that all of the at least one pusher remains mounted when the front barrel and the cartridge guide member are removed.

20. The writing instrument of claim 18 further comprising one of the at least one pushers for each of the at least one actuators.

* * * * *